United States Patent [19]

Smith

[11] 3,940,603

[45] Feb. 24, 1976

[54] FOUR QUADRANT MULTIPLYING DIVIDER USING THREE LOG CIRCUITS

[76] Inventor: John I. Smith, 4505 Ellicott St., Washington, D.C. 20016

[22] Filed: July 2, 1974

[21] Appl. No.: 485,098

[52] U.S. Cl. ..... 235/195; 235/194; 235/197; 328/145

[51] Int. Cl.[2] ..... G06G 7/16

[58] Field of Search ..... 235/194, 195, 197, 196; 328/145, 160, 161; 307/229, 230

[56] References Cited

UNITED STATES PATENTS

| | | | |
|---|---|---|---|
| 3,197,626 | 7/1965 | Platzer, Jr. | 235/195 |
| 3,453,423 | 7/1969 | Pu-Yuan Ma | 235/195 X |
| 3,532,868 | 10/1970 | Embley | 328/145 X |
| 3,676,661 | 7/1972 | Sprowl | 235/195 X |

*Primary Examiner*—Joseph F. Ruggiero
*Attorney, Agent, or Firm*—Morris Liss

[57] ABSTRACT

Three log circuits are fed by respective $x$, $y$ and $z$ inputs, along with predetermined interconnections therebetween. The outputs from the log circuits are log $z$, log $(x+z)$ and log $(y+z)$. These outputs are fed to summing and anti-log circuits to derive the equation $(xy)/z + x + y + z$. A second summing circuit is provided for substracting the three variables from the resultant output so that $(xy)/z$ is finally derived.

19 Claims, 5 Drawing Figures

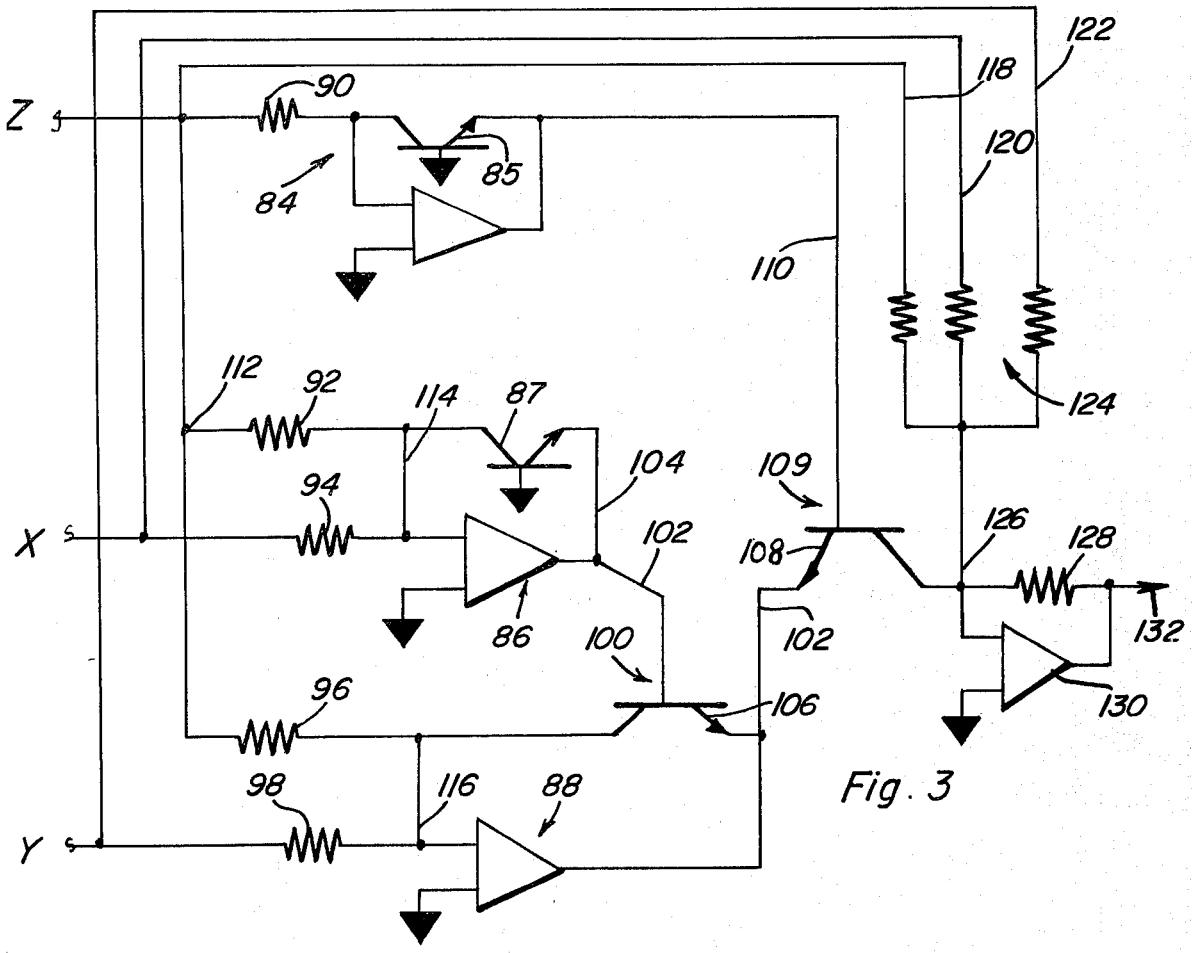
Fig. 3
Fig. 5
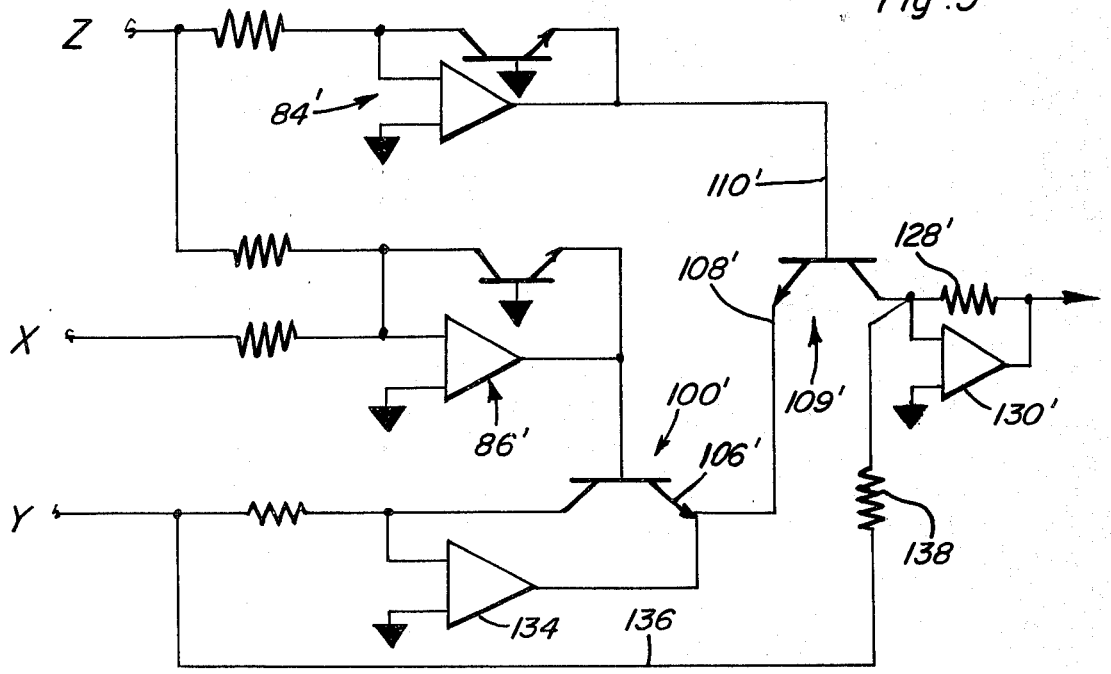

FOUR QUADRANT MULTIPLYING DIVIDER USING THREE LOG CIRCUITS

FIELD OF THE INVENTION

The present invention relates to analog circuits, and more particularly to such a circuit which serves as a four quadrant multiplying divider.

BRIEF DESCRIPTION OF THE PRIOR ART

In certain types of analog circuits, it is required to obtain the log of an electrical voltage or current. Such a logarithmic transfer is required in ratio meters, instrumentation, and analog computational devices.

Circuits have been developed which accomplish multiplication of two variables or the division of two variables. Lately, the analog circuits for accomplishing these functions include simple transistor circuits which are reliable and low cost. An example of such a circuit is U.S. Pat. No. 3,532,868 which is directed to a log multiplier with a logarithmic function generator connected in a feedback loop of an operational amplifier. Although this patent illustrates a typical log multiplier, it suffers from several disadvantages. For example, the patent is directed to a multiplier only. Further, it uses an operational amp as part of log transfer circuitry. Also a reference voltage is required, as are both pnp and npn transistors.

In other variations of such circuits, log dividers are made possible. Even log multiplying dividers have been designed. However, those have been for 2 quadrant operation which severly limits the flexibility of such a device.

Relevant references are disclosed in NONLINEAR CIRCUITS HANDBOOK, Analog Devices, Inc., pages 235, 239, 295 and 298.

BRIEF DESCRIPTION OF THE PRESENT INVENTION

The present invention represents a minimized hardware approach to a four quadrant multiplying divider.

Three individual log circuits are employed for operating upon three variable inputs. Several of the inputs are interconnected so that the log circuits produce the following outputs: Log $z$, Log $(x+z)$ and Log $(y+z)$. These outputs are summed in a predetermined manner and then undergo an anti-log function so that the output becomes $(xy)/+x+y+z$. By subtracting the $x$, $y$ and $z$ inputs from the anti-log output, the final output is derived as $(xy)/z$. This output is operative in four quadrants.

The circuitry is implemented with transistors and reduces the number of precision resistors normally required for similar log circuits. The end result includes the elimination of a differential amplifier which is normally included in similar log circuits.

BRIEF DESCRIPTION OF THE FIGURES

FIG. 3 is an electrical schematic diagram of a four quadrant multiplying divider, constituting a preferred embodiment of the present invention.

FIG. 5 is an electrical schematic diagram of a two quadrant multiplying divider, using the inventive concept of the embodiment shown in FIGS. 3 and 4.

DETAILED DESCRIPTION OF THE INVENTION

Figure 1:
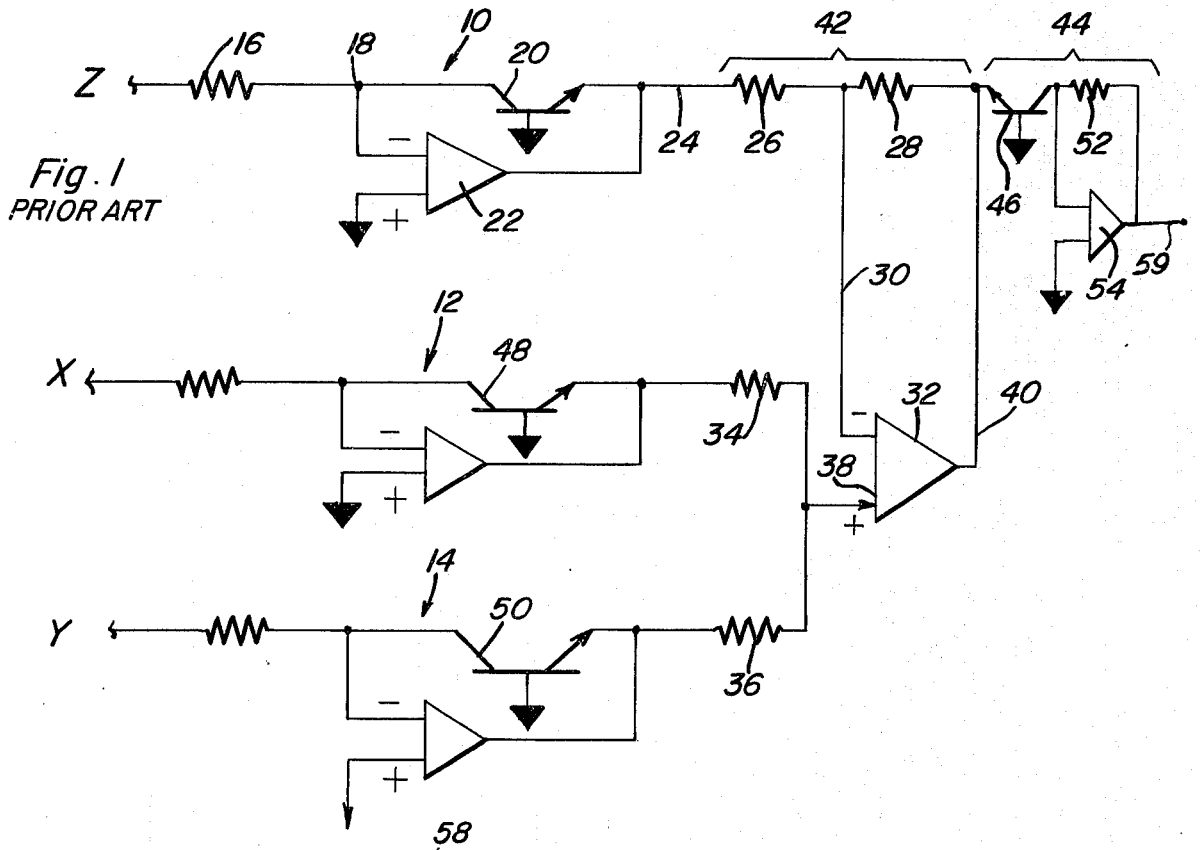
Fig. 1 PRIOR ART
FIG. 1 is an electrical schematic diagram of a one quadrant multiplying divider which is prior art.

Referring to the figures and more particularly FIG. 1 (prior art), the circuitry illustrated therein consists of three logarithmic transfer circuits 10, 12 and 14 as disclosed in U.S. Pat. No. 3,237,028. For example, an input voltage signal $z$ is applied through a resistor 16 to convert the voltage to a current. At virtual ground junction 18, the current is fed to an npn transistor 20 having operational amplifier 22 connected thereacross. The output voltage at the emitter of the transistor is the log $z$. This output, appearing along lead 24, is fed through a precision resistor 26. Up to now, each of the three branches, for the respective variables are identical. A difference amp 42 consists of the resistor 26 and its corresponding resistors 34 and 36 in the $x$ and $y$ branches, respectively. The difference amplifier which is connected to each of the variable branches includes another precision resistor 28 that has an end connected in common with resistor 26. The junction between these resistors is indicated by 30 and forms a negative input for operational amplifier 32. The second positive input 38 to the operational amplifier is connected at a junction point to corresponding ends of the resistors 34 and 36. The output 40 from the operational amplifier 32 is connected to an opposite end of resistor 28, which forms the input for an anti-log circuit 44. This anti-log circuit has the function of reconstituting an algebraic transfer function, from the logarithmic output at operational amplifier 32, which is equal to $\log x + \log y - \log z$. The antilog circuit 44 is prior art and is disclosed in U.S. Pat. No. 3,293,450.

Basically, such an antilog circuit includes a transistor 46 having a grounded base, the transistor being of the npn type. The transistor 44 feeds its output, from the collector, to an amplifier including operational amplifier 54 and parallel connected resistor 52. It will be noted that the use of a consistent transistor type has been maintained through all transistor stages. Particularly, npn transistors with grounded bases have been used. However, it will be evident to those of ordinary skill that pnp transistors may likewise be used.

However, it is important to note that the transistors in the circuit of FIG. 1 are matched in a particular way. That is, transistors 20 and 48 constitute a matched pair, while transistors 50 and 46 constitute a matched pair. Typically, the transistors are silicon, small signal bipolar transistors. The output appears along lead 56, from the output of the operational amplifier 54. The resultant transfer is $(xy)/z$. The restraints upon the variables are that $x$, $y$ and $z$ are the same sign and greater than zero. Thus, the configuration illustrated in FIG. 1 is a one quadrant multiplying divider.

Figure 2:
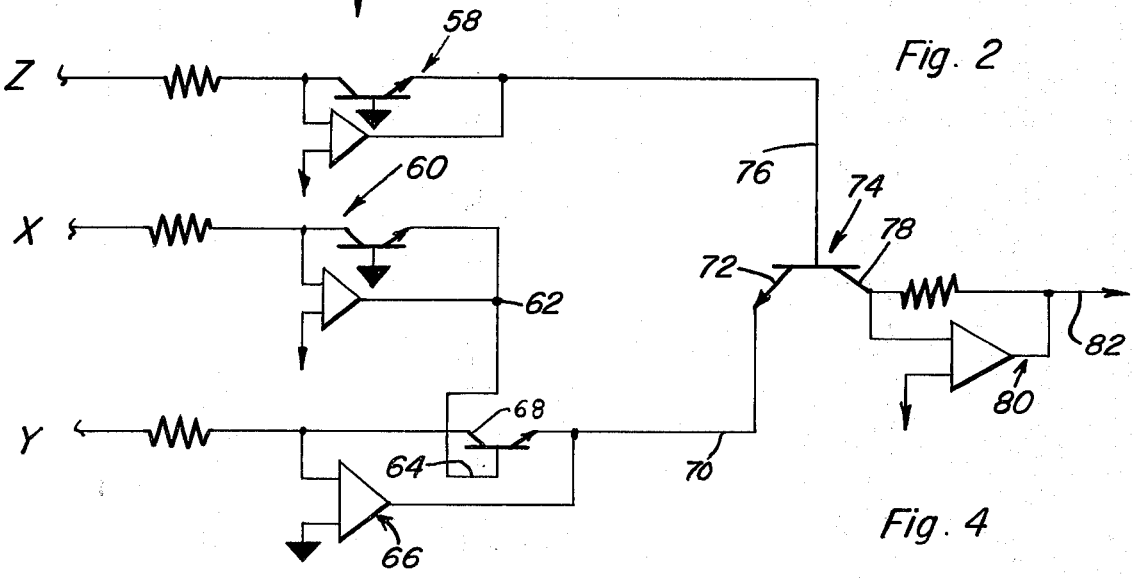
FIG. 2 is another one quadrant multiplying divider, but is an improvement over the embodiment shown in FIG. 1 in that it eliminates the differential amplifier.

FIG. 2 illustrates a hardware minimizing technique for eliminating the difference amplifier, 42, of the previous embodiment (FIG. 1). This embodiment is similar to a circuit disclosed in the previously mentioned NONLINEAR CIRCUITS HANDBOOK, Analog Devices, Inc., pages 235, 239, 295 and 298. The conventional log transfer circuits 58 and 60 are employed to derive log $z$ and log $x$ from their respective input voltage variables $z$ and $x$. However, rather than duplicating the transfer circuit for the variable $y$, a modified transfer circuit is employed. A transistor 68 is connected across an amplifier 66, as is done in the transfer circuits 58 and 60. However, the output from the transfer circuit 60, as indicated at terminal 62, is fed to the base 64 of the transistor 68. This is in contrast to the usual grounding of the base terminals. As a result, the output lead 70 carries the log function $\log x + \log y$.

The emitter of transistor 68 is connected, via output lead 70, to the emitter 72 of a fourth transistor stage 74. The base of transistor 74 is connected to the output of the transfer circuit 58 so that $\log z$ is introduced into the base of transistor 74 along lead 76. Flowing out of the collector terminal 78 is a current proportional to the antilog ($\log x + \log y - \log z$). Thus, as will be appreciated, transistor 74 serves as a combination antilog circuit and difference stage 80 is connected to the collector 78 to complete a current to voltage converter whereby the output 82 now carries the value $(xy)/z$. Accordingly, it will be seen that the embodiment of FIG. 2 represent a one quadrant multiplying divider.

In order to better appreciate the final output from the circuit of FIG. 2, the mathematics will be derived.

Transistors 58 and 60 are matched while transistors 68 and 74 are matched. Note that the collector-emitter voltages for transistor 68 and 74, are identical. Further, in accordance with the analysis given in the article "Logarithmic Devices" by R. J. Gurski, in the periodical The Lightening Empiricist Vol. 17, No. 1, March 1969, published by Philbrick/Nexus Research:

$$V_{be68} = \log y - (1/\mu)\, V_{ce68}$$
$$V_{be74} = \log w - (1/\mu)\, V_{ce74}$$
$$V_{be58} = \log z$$
$$V_{be60} = \log x$$

Thus, the log of the output current from transistor 74 is equal to $\log x + \log y - \log z$, as shown below.

Bearing in mind that the base terminals of transistors 58 and 60 are grounded, and that the emitter of transistor 58 is connected to the base of transistor 76, and further that the emitters of transistors 68 and 74 are connected, using Kirchhoff's Law:

$$V_{be74} = V_{be60} + V_{be68} - V_{be58}$$

thus, $$\log w - (1/\mu)\, V_{ce74} = \log x + \log y - (1/\mu)\, V_{ce68} - \log z.$$

Since $V_{ce74}$ is identically equal to $V_{ce68}$:

$\log w$ is equal to $\log z + \log y - \log z$.

In the above, $\log w$ is equal to the log of the output current from transistor 74.

Referring to FIG. 3, a four quadrant multiplying divider is illustrated. This forms the preferred embodiment of the present invention. As will be seen, no separate difference amplifier is employed. Considering FIG. 3, a strong resemblance will be seen between the represented four quadrant multiplying divider and the single quadrant multiplying divider of FIG. 2. The log transfer circuit 84 of FIG. 3 is similar to that of 58 in FIG. 2. The variable $z$ is introduced to the log transfer circuit, through the voltage-current converting resistor 90. The output from the log transfer circuit is $\log z$.

A second log transfer circuit 86 receives an input of the variable $x$, after voltage-conversion through resistor 94. The variable $z$ is also introduced, at junction 114, to the log transfer circuit 86, through the voltage-current converting resistor 92. The output lead 104 from the log transfer circuit 86 is connected to the base terminal 102 of a transistor 100, which performs a similar function as transistor 68 in FIG. 2.

The collector terminal of transistor 100 is connected to the variable $z$, through the voltage-current converting resistor 96. The variable $y$ is connected to the input of the third log transfer circuit 88, through a voltage-current converting resistor 98. Connecting lead 116 couples the variable $z$ to the log transfer cicrcuit 88. Further, due to the connection of transistor 100 to the output of log transfer circuit 88, the output from the log transfer circuit 88 is a complex log equation involving all three variables. Specifically, the output signal is $\log (x + z) + \log (y + z)$. The emitter 106 of transistor 100 is tied to the emitter 108 of transistor 109, the latter serving as an antilog stage. The output current of transistor 109 includes a $z$ variable term due to the connection of the base of transistor 109 to the output of the log transfer circuit 84 via lead 110.

Each of the input variables $x$, $y$ and $z$ are tied to the output of the circuit via leads 120, 122 and 118 respectively. The effects of these variables are subtracted from the circuit through respective resistors, generally indicated by reference numeral 124. The lower end of these resistors are tied together and connected to the final current to voltage converting stage through connecting lead 126. The final converting stage operates in a manner similar to that shown in FIG. 2, and constitutes a resistor 128 connected in parallel with an operational amplifier 130. The final output 132 constitutes the value $(xy)/z$.

To appreciate the mathematics related to the embodiment of FIG. 3, the following equations are considered. Again, by applying Kirchhoff's Law:

$$V_{be109} = V_{be87} + V_{be100} - V_{be85}$$
$$= \log (x + z) + \log (y + z) - \log z$$
$$\log i_{c109} = \log (x + z) + \log (y + z) - \log z$$
$$\log i_{c109} = \log \left( \frac{xy}{z} + x + y + z \right)$$
$$i_{c109} = \frac{xy}{z} + x + y + z$$

Thus, the net input current to the output operational amplifier 128, 130 is:

$$i_{c109} - x - y - z.$$

Accordingly, the output voltage at 132 is $(xy)/z$.

The constraints regarding the variables are as follows:

$$x > -z$$
$$y > -z$$
$$z > 0$$

The forbidden values for the variables are as follows:

negative $x$ exceeding the magnitude of $z$.

negative $y$ exceeding the magnitude of $z$.

The input variables collectively are constrained such that the output voltage does not exceed plus or minus its full scale rating; this contraint is common to all such analog computing circuitry and is well known.

Figure 4:
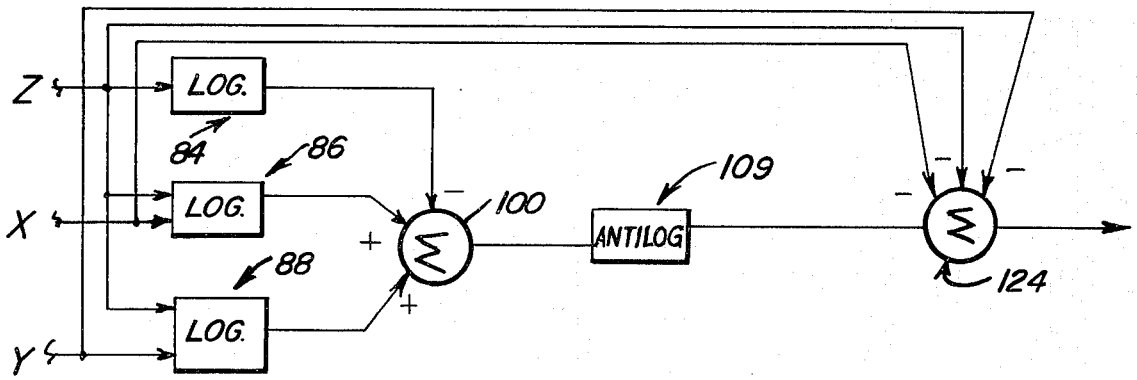
FIG. 4 is an electrical block diagram of the circuitry shown in FIG. 3.

FIG. 4 illustrates a block diagram of the circuitry shown in FIG. 3. Corresponding reference numerals have been employed to shown corresponding portions of the circuitry.

FIG. 5 illustrates the circuitry required for a two quadrant version of the multiplying divider disclosed in connection with FIG. 4.

The log transfer circuits in connection with the variables $z$ and $x$ are substantially the same as those shown in FIG. 3. Accordingly, corresponding numerals have been used. However, the variable y is fed to an operational amplifier 134, which is connected to the emitter 106′, as was the case in FIG. 3. The subtraction of the variable $y$ occurs through branch 136 and precision resistor 138. The output from the emitter 106′ is log ($x$ $+ z) + \log (y)$. The collector current from transistor stage 109' $= (xy)/z + y$. However, due to the subtraction of the variable $y$, the converter 128', 130' generates a voltage output that is equal to $(xy)/z$.

As in the case of the four quadrant version in FIG. 3, transistors in the log transfer circuits 84' and 86' are matched, while the transistors 100' and 109' are also matched.

The range of permissible input variables are as follows:

$z > 0$
$y > 0$
$x > -z$

Accordingly, as will be appreciated, the multiplying divider of the present invention is seen to include a reduction of hardware for effecting the design of a multiplying divider. Separate difference amplifiers are not needed.

A minimum number of precision resistors all of the same value are used in the preferred embodiments of FIGS. 3 and 5.

It should be understood that the invention is not limited to the exact details of construction shown and described herein for obvious modifications will occur to persons skilled in the art.

For example, it would be obvious to apply a bias voltage to the base of the front end transistors or the grounded terminal of the loging transistor, for example component 22 in FIG. 1. The purpose of this is to achieve overall gain balancing adjustment.

Wherefore I claim:

1. An analog multiplying divider for three input variables $x$, $y$ and $z$, the multiplying divider comprising:

first circuit means for performing a log transfer operation upon the variable $z$;

second circuit means for performing a log transfer operation upon at least the variable $x$;

third circuit means for performing a log transfer operation upon at least the variable $y$;

the third circuit means including first means for summing at least $\log y$ and the $\log x$ output from the second circuit means to form a summation signal which is a function of $\log x + \log y$;

second summing means having inputs thereof connected to the output of the first circuit means and the third circuit means for producing the antilog $(\log x + \log y - \log z)$; and output means connected to the output of the second summing means for producing $(xy)/z$ at the output thereof.

2. The subject matter of claim 1 wherein the second summing means includes a transistor having first, second and third electrodes;

the first electrode connected to the output of the first circuit means;

the second electrode connected to the output of the third circuit means; and the third electrode connected to the input of the output means.

3. The circuitry as defined in claim 2 wherein the first electrode of the summing means transistor is a base electrode.

4. The subject matter of claim 1 wherein the multiplying divider functions for four quadrant operation, and further wherein the second circuit means comprises:

an input terminal for the variable $z$;

amplifier means having an input thereof connected to the input terminal;

a transistor having first and second electrodes respectfully connected between the input and output of the amplifier means;

an input terminal for the variable $x$;

the input of the amplifier means connected to the variable $x$ input terminal;

the second electrode carrying a resultant signal $\log (x + z)$.

5. The subject matter of claim 4 wherein the third circuit means comprises:

an input terminal for the variable $y$;

amplifier means having an input thereof connected to the first input terminal;

a transistor having first and second electrodes respectfully connected between the input and output of the amplifier means;

means connecting a third electrode of the transistor to the output of the second circuit means, the second electrode carrying a resultant signal $\log (x + z) + \log (y + z)$.

6. The subject matter of claim 4 wherein the third electrode of the transistor is a base electrode.

7. The subject matter of claim 6 wherein the second summing means includes a transistor having first, second and third electrodes;

the first electrode connected to the output of the first circuit means;

the second electrode connected to the output of the third circuit means; and the third electrode connected to the input of the output means.

8. The subject matter of claim 7 wherein the first electrode of the summing means transistor is a base electrode.

9. The subject matter of claim 4 together with means respectively connecting the input variables to the input of the output means of the second summing means for subtracting the variables $x$, $y$ and $z$ from the output of the second summing means, thus producing $(xy)/z$ at the output of the output means.

10. The circuitry as defined in claim 9 wherein the subtracting means comprises individual resistors respectively connected at first ends thereof to the input variables $x$, $y$ and $z$, the opposite ends of the resistors connected together at the input of the output means.

11. The subject matter of claim 10 wherein the output means comprises:

amplifier means having an input connected to the third electrode of the second summing means; and a resistor connected between the input and output of the amplifier means.

12. The subject matter of claim 1 wherein the multiplying divider functions for two quadrant operation, and further wherein the second circuit means comprises:

an input terminal for the variable $z$;

amplifier means having an input thereof connected to the input terminal;

a transistor having first and second electrodes respectfully connected between the input and output of the amplifier means;

an input terminal for the variable $x$;

the input of the amplifier means connected to the variable $x$ input terminal;

the second electrode carrying a resultant signal $\log (x + z)$.

13. The circuitry set forth in claim 12 wherein the third circuit means comprises:

an input terminal for the variable $y$;

amplifier means having an input thereof connected to the first input terminal;

a transistor having first and second electrodes respectively connected between the input and output of the amplifier means;

means connecting a third electrode of the transistor to the output of the second circuit means, the second electrode carrying a resultant signal $\log (x+z) + \log y$.

14. The subject matter of claim 12 wherein the third electrode of the transistor is a base electrode.

15. The subject matter of claim 14 wherein the second summing means includes a transistor having first, second and third electrodes;

the first electrode connected to the output of the first circuit means;

the second electrode connected to the output of the third circuit means; and the third electrode connected to the input of the output means.

16. The subject matter of claim 15 wherein the first electrode of the summing means transistor is a base electrode.

17. The subject matter of claim 12 together with means connecting the input variable $y$ to the input of the output means of the second summing means for subtracting the variable $y$ from the output of the second summing means, thus producing $(xy)/z$ at the output of the output means.

18. The subject matter of claim 17 wherein the subtracting means comprises a resistor connected at a first end thereof to the input variable $y$, the opposite end connected to the input of the output means.

19. The subject matter of claim 18 wherein the output means comprises:

amplifier means having an input connected to the third electrode of the second summing means; and a resistor connected between the input and output of the amplifier means.

* * * * *